US005544751A

United States Patent [19]

Klodt et al.

[11] Patent Number: 5,544,751

[45] Date of Patent: Aug. 13, 1996

[54] STACKING CONNECTOR FOR STORAGE CONTAINER

[75] Inventors: Gerald Klodt, Baraboo; Timothy D. Killinger, Prairie du Sac, both of Wis.

[73] Assignee: Flambeau Products Corp., Middlefield, Ohio

[21] Appl. No.: 433,316

[22] Filed: May 3, 1995

[51] Int. Cl.[6] ..... B65D 21/032

[52] U.S. Cl. ..... 206/509; 206/821; 206/511; 206/512; 220/4.27

[58] Field of Search ..... 220/4.26, 4.27, 220/23.83, 23.86, 23.6; 206/509, 511, 512, 821; 403/327, 329

[56] References Cited

U.S. PATENT DOCUMENTS

| | | | |
|---|---|---|---|
| 4,212,415 | 7/1980 | Neely | 220/4.26 |
| 4,664,283 | 5/1987 | Liu | 206/509 |
| 4,823,955 | 4/1989 | Apps | 206/512 |
| 4,896,926 | 1/1990 | Verholt | 220/4.26 |
| 5,246,105 | 9/1993 | Eykmann et al. | 220/4.27 |

FOREIGN PATENT DOCUMENTS

| | | | |
|---|---|---|---|
| 2208696 | 4/1989 | United Kingdom | 403/327 |

*Primary Examiner*—Stephen J. Castellano
*Attorney, Agent, or Firm*—Banner & Allegretti, Ltd.

[57] ABSTRACT

A connector for detachably securing together stacked molded plastic trays, which connector has a resilient tab projecting from a lower tray which slides into a slot in the tray above. Each slot has a rib rising from the tray bottom along one edge of the slot and a leaf spring integrally molded with the tray side wall opposite the rib. When the tab is inserted in the slot, the spring urges the tab against the rib and a lip on the tab hooks over the top edge of the rib.

11 Claims, 2 Drawing Sheets

STACKING CONNECTOR FOR STORAGE CONTAINER

This invention relates to a modular plastic box and more particularly to connector means for securing together modular trays to increase or reduce the amount of storage in the box. Boxes of this kind can be used for fishing tackle, hardware, art storage and for organization of small articles.

The object of the invention is to provide a simple effective connector which is integrally molded from plastic resin as part of the container thus requiring no additional parts such as springs, clips or the like to hold the containers together. The box made in accordance with the invention, including the connectors, are molded from thermoplastic resin such as polypropylene, high density polyethylene and similar materials which are horny in nature and have resilience.

Connectors of this type are generally not detachable. Such one-way snaps have a semirigid tab which is forced through an opening or slot having smaller dimensions than the terminal end of the tab. The terminal end has a projection which, after insertion, rests on the margin of the slot. The tab cannot be released because the slot is not wide enough to permit flexing the tab to move the projection off the margin of the slot, or the tab is too rigid to flex sufficiently to permit release.

The detachable connector of the invention consists of two parts, a tab projecting upwardly from the side wall of one tray, and a cooperating slot in the bottom of another tray stacked above said first tray. Each modular tray is identical in construction and has both a tab(s) and a cooperating slot(s). Each slot has a vertical wall or rib rising from the tray bottom along one edge of the slot and leaf spring means integrally molded with the tray side wall opposite said vertical wall. The ends of the leaf springs, in non-biased position, are spaced from the vertical wall a distance less than the thickness of the tab so that when the tab is inserted in the slot, the springs are pushing against the face of the tab to hold it in locked position as described below. The tab may be removed by manually pressing the tab against the force of the leaf springs to unlock it and remove it through the slot.

To permit releasably locking the tab within the slot, the tab terminates in an inwardly-extending lip which snaps over the top edge of the vertical rib along the slot edge when the tab is inserted in the slot. The lip preferably is triangular in cross section, the base of the triangle being in contact with the vertical rib. The portion of the triangle above the base serves as a finger-push area and may have a ribbed surface. The leaf springs flex sufficiently to permit the tab to pass through the slot. When the tab is fully inserted, the lip rests on the top edge of the vertical rib and is held in that position by the springs. The tab cannot be removed from the slot until the lip is pushed off the vertical rib. Thus, multiple trays may be connected together to form a unitary bin. Removal of one tray from an adjacent tray may be accomplished manually or by using a screwdriver to push the tab against the force of the springs.

The trays preferably have connectors at each corner which permit stacking them in aligned position, locked against lateral or vertical movement with respect to each other. By molding the trays from tough resilient plastic material, the cooperating tabs and leaf springs permit locking the trays securely, but detachably, together. No separate parts are required other than the molded trays themselves.

These and other objects will become apparent from the following description when read in connection with the accompanying drawings in which FIG. 1 is a perspective view of a storage box constructed in accordance with the invention.

Figure 1:
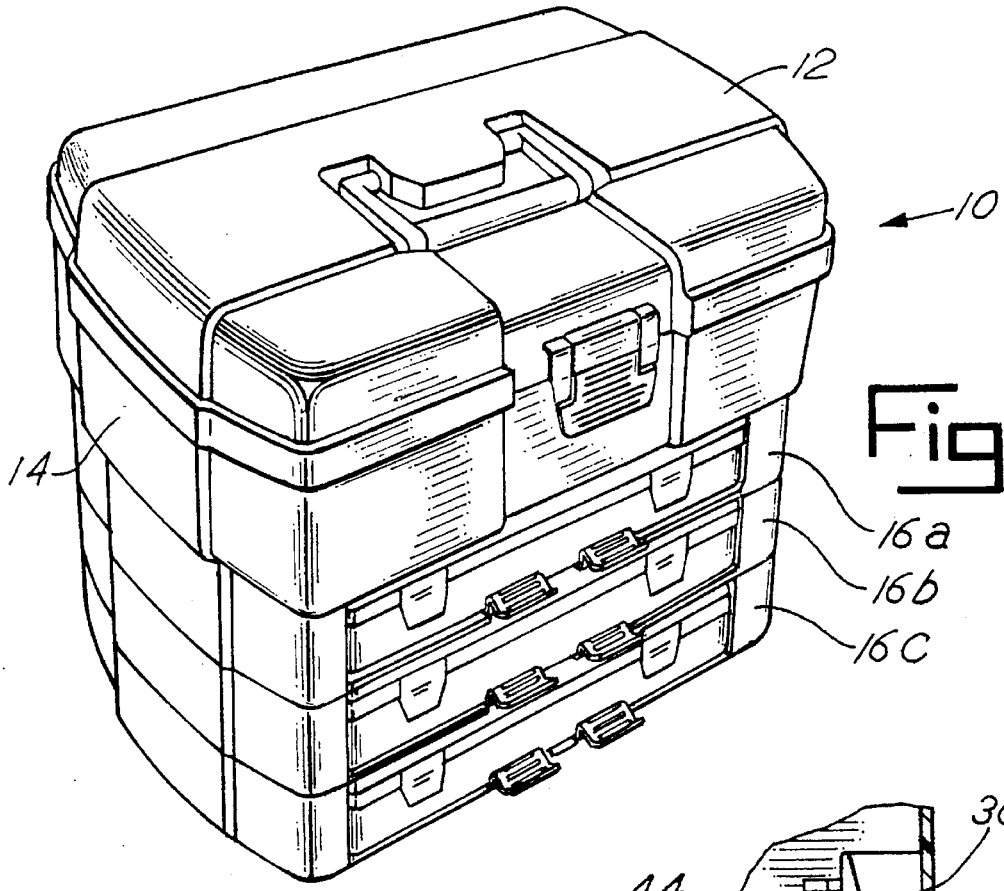
Figure 5:
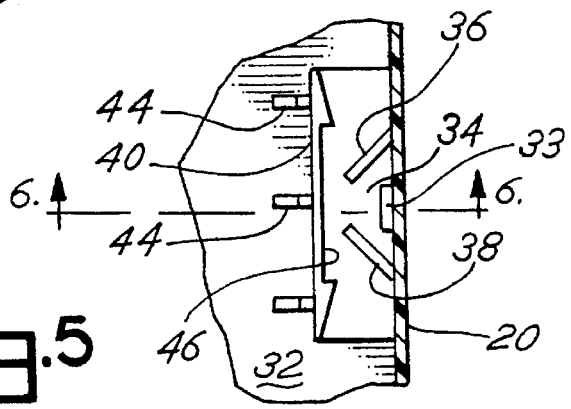
FIG. 5 is a top plan view of the opening in the bottom of the tray for receiving the tab on an adjacent stacked tray.
Figure 6:
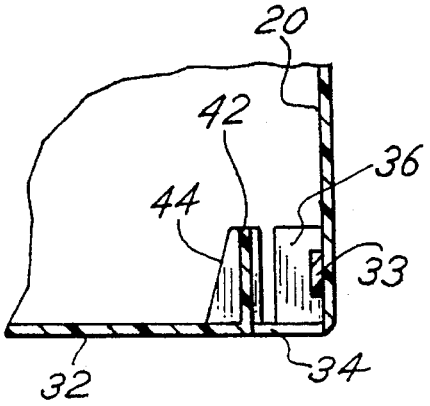
FIG. 6 is a side view of the opening in the bottom and the accompanying elements, taken along the line 6—6 of FIG. 5.
Figure 2:
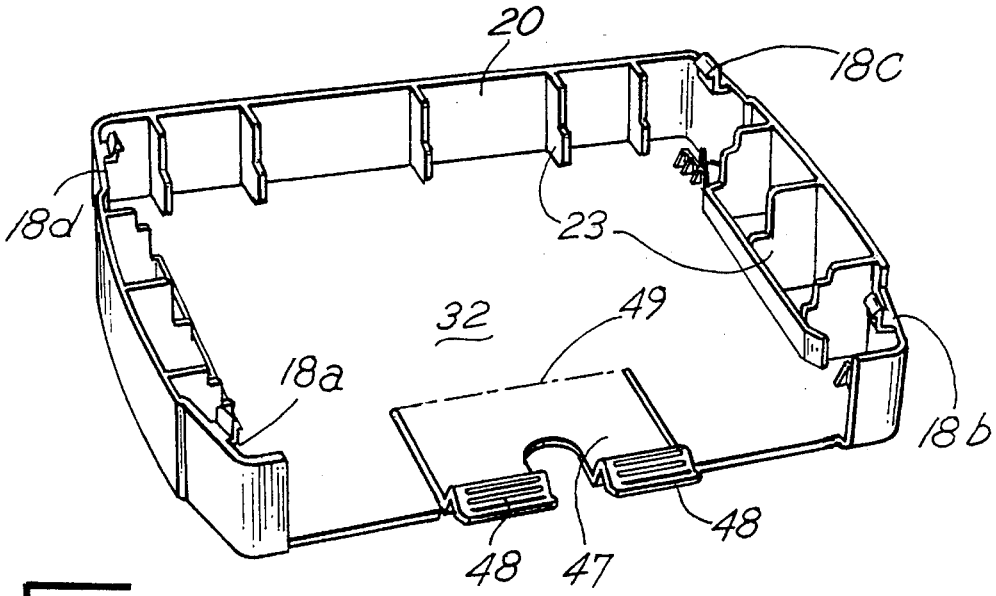
FIG. 2 is a perspective view of a tray module having connectors at each of the four corners.
Figure 3:
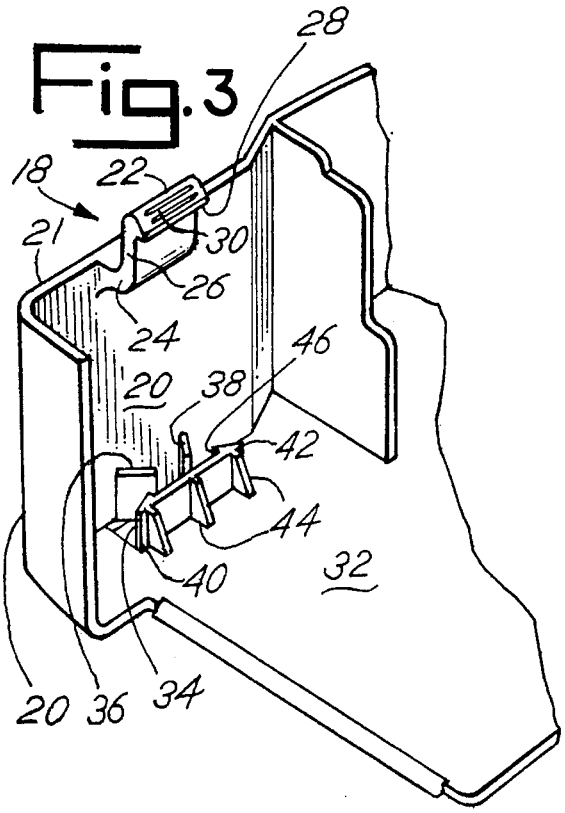
FIG. 3 is an enlarged perspective view from the inside of a single tray showing the elements constituting the connector.
Figure 4:
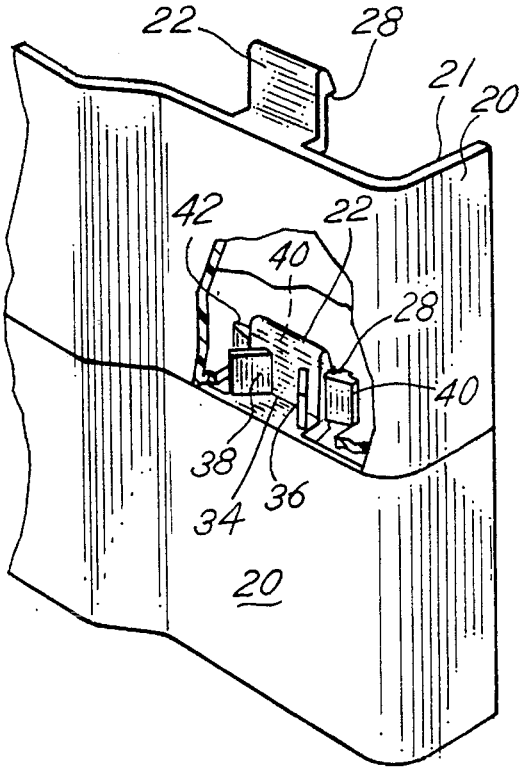
FIG. 4 is a perspective view from the outside showing two modular trays connected together, a portion of the upper tray being broken away to show the interaction of the connector elements.

Referring to FIG. 1, the box 10 has a body portion 14 and a hinged top 12. Beneath the body portion 14 and secured thereto by connectors are trays 16*a*, 16*b* and 16*c* which are stacked to provide a unitary bin having three additional trays. As best shown in FIG. 2, the tray 16 has a peripheral side wall 20, a bottom 32 and connectors 18*a, b, c,* and *d* at each corner of the tray. The side wall 20 is reinforced with integrally-molded ribs 23. The tray has no front wall and the top, of course, is open.

Each of the trays used in forming the modular bin is constructed in the same manner insofar as the connector is concerned. The connector is designed so that the trays can be stacked one over the other and locked securely in place against vertical or lateral movement. The connector construction is shown in FIGS. 3–6. The tray bottom 32 has an elongated opening or slot 34 adapted to receive a tab 22 projecting upwardly from the top edge 21 of the tray side wall 20. Molded on the inner surface of side wall 20 are a pair of leaf springs in the form of ears 36, 38 projecting into the space above the opening 34 at an acute angle to the surface of the side wall. Because these springs are molded from resilient plastic material, they will flex and offer resistance to bending. A stop 33 projects from wall 20 to prevent the springs from being overstressed. A vertical rib 40, parallel to side wall 20, projects upwardly along the inner side of the slot 34, rising to the same height as the spring members 36, 38. Triangular reinforcements 44 serve to reinforce the vertical rib 40 so that it does not flex significantly under the force of the tab which, upon stacking, extends into the opening and is urged by the springs toward the vertical rib 40. The face of the rib 40 has a recess or guide means 46 equivalent in width to the width of the tab 22, which recess receives the tab and prevents lateral movement. See FIG. 5. The tab 22, having an L-shaped cross section consisting of a horizontal offsetting portion 24 and a vertical portion 26, is molded to the wall 20 at the top edge 21 thereof. The tab is offset with respect to the side wall to accommodate the side wall of an adjacent stacked tray. The top of the tab 22 terminates in a lip 28 which projects inwardly of the tab. The distance between the top edge 21 of the wall 20 and the underside of the lip 28 is equal to the height of the vertical rib 40. Thus, the lip 28 snaps over the top edge of the rib 40 as the tab slides into the recess 46 in the face of the wall 40. Preferably, the lip is triangular in cross section. The base of the triangle rests on the rib 40 and the upper portion 30 of the triangle serves as a finger-push area 30 which may be ribbed to facilitate gripping the lip.

When two trays are stacked, each tab 22 moves up into the slot 34 between the ends of the springs 36, 38 on one side and the rib 40 on the other. See FIG. 4. The distance between the ends of the springs (not compressed) and the rib 40 is smaller than the thickness of the tab 2. Consequently, when the springs are compressed as the tab moves upwardly, they urge the tab into contact with the rib 40. The shoulders at the ends of the recess 46 prevent the tab from moving laterally and the overlap of the lip prevents the adjacent trays from separating vertically. When it is desired to remove one of the trays, the tabs are pushed against the force of the springs so that the lip 28 is spaced from the top edge of the wall 40 which permits the tab and the tray connected thereto to be released from the adjacent tray.

As shown in FIG. 2, the front of the tray is open. Formed in the bottom 32 is a hinged flap 47 which flexes about the line 49. Finger snaps 48 are molded in the front edge of the flap 47 and project above the surface of the bottom 32 beyond the margin thereof. A drawer or box (not shown) may be inserted in the tray and is held in position by the snaps 48 which are depressed to permit removing the drawer.

What is claimed is:

1. A connector for removably connecting a plurality of molded plastic trays to each other in stacked relation, each tray having a bottom and a side wall, said connector being integrally molded as part of the side wall and bottom of each said tray, said side wall having a top edge, an inner surface, and an outer surface, said connector comprising a tab projecting inwardly and upwardly from said top edge and terminating in an inwardly-extending lip, an opening in said tray bottom aligned with said tab to receive the tab of an adjacent stacked tray, spring means integrally molded with said inner surface and extending into the space above said opening, a vertical rib extending upwardly from said tray bottom opposite said spring means and terminating in an upper edge, whereby said trays may be stacked with a tab on one tray inserted in the opening in the bottom of an adjacent tray with said tab disposed between said spring means and said vertical rib, said lip engaging said upper edge of said vertical rib.

2. The connector of claim 1 in which said spring means consists of a pair of ears disposed at an acute angle to said inner surface.

3. The connector of claim 1 in which said tab is offset with respect to said side wall to accommodate the side wall of said adjacent stacked tray.

4. The connector of claim 3 in which said vertical rib has a recess just wide enough to receive said tab and prevent lateral movement thereof within said opening.

5. The connector of claim 3 in which said lip is triangular in cross section and has longitudinal ribs on the upper surface thereof to facilitate manual gripping of the tab.

6. The connector of claim 2 which includes a stop projecting from said side wall between said ears.

7. The connector of claim 1 in which each tray is approximately rectangular in shape and includes a connector at least two corners thereof.

8. The connector of claim 7 in which each tray is open at the top, the side walls of which enclose only three sides leaving the fourth side open.

9. The connector of claim 8 in which a hinged flap is molded into said bottom adjacent said fourth open side and has finger snaps on the free edge thereof to facilitate flexing said hinged flap.

10. The connector of claim 1 in which the top tray in said stack is detachably connected to a body portion having a lid and a handle secured to said lid.

11. A connector integrally molded in the side wall and bottom of a generally rectangular container having a peripheral side wall, a bottom and an open top, said side wall having a top edge, said connector comprising a tab L-shaped in cross section projecting inwardly and above said top edge and terminating in an inwardly-extending lip, an elongated slot in said bottom aligned with said tab for receiving the tab of an adjacent stacked container, a vertical rib extending upwardly from said bottom at the side of said slot and terminating in an upper edge, leaf spring means integrally molded with said side wall opposite said vertical wall and extending into said slot, whereby the tab on one container is inserted in the slot of an adjacent stacked container with said lip overlapping said upper edge of the vertical rib, said spring means urging said tab against said vertical rib.

* * * * *